US007070126B2

(12) United States Patent
Shinogle

(10) Patent No.: US 7,070,126 B2
(45) Date of Patent: Jul. 4, 2006

(54) FUEL INJECTOR WITH NON-METALLIC TIP INSULATOR

(75) Inventor: Ronald D. Shinogle, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 673 days.

(21) Appl. No.: 09/851,739

(22) Filed: May 9, 2001

(65) Prior Publication Data

US 2002/0166537 A1 Nov. 14, 2002

(51) Int. Cl.
*B05B 1/30* (2006.01)

(52) U.S. Cl. ..... 239/584; 239/397.5; 239/533.12; 239/585.1; 123/470

(58) Field of Classification Search ..... 239/397.5, 239/533.2, 533.12, 533.15, 583, 584, 585.1; 123/298, 470

See application file for complete search history.

(56) References Cited

U.S. PATENT DOCUMENTS 4,245,589 A * 1/1981 Ryan ..... 123/298
4,742,964 A * 5/1988 Ito et al. ..... 239/397.5
4,877,187 A * 10/1989 Daly ..... 239/585.4
5,161,379 A 11/1992 Jones et al.
5,384,200 A 1/1995 Giles et al.
5,400,969 A * 3/1995 Keene ..... 239/136
5,941,459 A 8/1999 Brooker et al.
5,943,994 A * 8/1999 Hosoi et al. ..... 123/468
5,967,419 A * 10/1999 Yamaguchi et al. ..... 239/397.5
5,987,882 A 11/1999 Voss et al.
6,009,856 A * 1/2000 Smith et al. ..... 123/470
6,186,419 B1 * 2/2001 Kampmann et al. ... 239/533.12
6,196,195 B1 3/2001 Trutschel et al.
6,276,338 B1 * 8/2001 Kato et al. ..... 123/470
6,427,667 B1 * 8/2002 Kato ..... 123/470

FOREIGN PATENT DOCUMENTS

| | | |
|---|---|---|
| CH | 353211 | 5/1961 |
| DE | 617251 | 7/1935 |
| DE | 3404709 A * | 8/1985 |
| EP | 0151793 | 8/1985 |
| EP | 0 151 793 B1 | 3/1989 |
| GB | 2182978 | 5/1987 |
| JP | 11021679 | 1/1999 |

* cited by examiner

*Primary Examiner*—Steven J. Ganey
(74) *Attorney, Agent, or Firm*—Liell & McNeil

(57) ABSTRACT

A fuel injector is provided which has an injector body with a metallic tip having an outer surface. A non-metallic insulator, such as a ceramic, is attached to the tip and covers a portion of the outer surface. Injector tip overheating can be a problem, especially during sustained two-cycle boosted engine compression release braking. In addition, injector tip overheating can be a problem when an engine is experiencing simultaneous engine compression release braking and exhaust braking.

18 Claims, 2 Drawing Sheets

FUEL INJECTOR WITH NON-METALLIC TIP INSULATOR

TECHNICAL FIELD

The present invention relates generally to fuel injectors, and more particularly to an injector with a non-metallic insulator attached to a portion of the injector tip.

BACKGROUND ART

In most diesel engines, fuel injectors are positioned such that at least a portion of the injector tip protrudes into the engine combustion space. The injector tip is thus exposed to the high temperatures and pressures from fuel combustion and engine compression release braking. In these injectors which employ a needle valve to control the fuel spray, the valve seat can potentially be heated to close to its tempering temperature during engine compression release braking. During normal engine operation, the fuel travelling through the injector tip carries heat away. During engine braking, however, fuel spray is halted and the injector tip is thus more susceptible to heat transfer from the air in the cylinder.

Depending on the capabilities of the individual system, engine braking can be executed in a four cycle or two-cycle fashion, placing a retarding torque on the engine by forcing the pistons to compress air without a subsequent power stroke. In addition, it might be desirable to operate the engine such that the engine brake is used in combination with an exhaust valve or variable geometry turbo. In four-cycle engine braking, air is compressed within a cylinder by every other upward piston stroke. In two-cycle engine braking, air is compressed during every upward stroke. Once compressed, the air is released through an exhaust line or, in boosted engine braking, released into another cylinder via the exhaust manifold to add to that cylinder's initial mass and pressure before its compression stroke.

Boosted engine braking is a useful means of applying even higher retarding torques to the engine. However, this boosted compression of the air tends to heat the injector tip substantially, particularly in two-cycle boosting applications. In addition, the injector tip can be heated substantially during periods of simultaneous engine braking and exhaust braking. If the compressed air is allowed to heat the injector nozzle valve seat to its tempering temperature, the hardness of the valve seat material can be reduced. Because the valve seat is subjected to repeated impacts by the needle valve member, softening of the valve seat material can result in quicker wear and distortion of the seat, leading to improper sealing. Additionally, weakening of the metal in the area of the valve seat can accelerate fatigue, which can eventually lead to tip breakage and catastrophic engine failure. Exotic metal alloys with higher tempering temperatures could be used in the injector tip, however, the use of these materials is often cost-prohibitive. It is thus desirable to develop a new method of protecting the injector tip from overheating.

Heat insulating coatings and structures are known in the art and have been employed in internal combustion engines for some time. Coating the combustion chamber surfaces with a non-metallic insulator allegedly results in higher combustion temperatures and consequently more complete fuel burning. Similar coatings have been used in engine exhaust systems to maintain higher exhaust temperatures, reducing undesirable emissions. These methods appear to serve their intended purpose, which is to enhance the thermal efficiency of internal combustion engines. However, such methods are directed to treatment of relatively large surfaces within the combustion chamber, and to ensuring higher combustion temperatures rather than protecting engine components from overheating. One example of such a coating method can be found in U.S. Pat. No. 5,384,200, issued to Giles et al. on Jan. 24, 1995. The Giles method involves depositing a porous ceramic material comprised of 10%–15% volume porosity Yttria partially stabilized zirconia, or 10%–15% volume porosity Ceria-Yttria partially stabilized zirconia on a metallic layer to maintain the combustion space at a higher temperature during combustion. However, Giles does not contemplate thermal coating of the injector tip, presumably because doing to would have only a negligible effect on enhancing thermal efficiency.

The present invention is directed to overcoming one or more of the problems set forth above.

DISCLOSURE OF THE INVENTION

A fuel injector is provided which includes an injector body with a metallic tip. A non-metallic insulator is attached to a portion of the outer surface of the tip.

In another aspect, the present invention provides a method of reducing injector tip overheating. This method includes the steps of providing a fuel injector with a metallic tip having an outer surface, and attaching a non-metallic insulator to a portion of the outer surface of the tip.

In still another aspect, the present invention provides an engine. The engine includes a housing, to which a plurality of fuel injectors are attached. Each of the fuel injectors has a metallic tip with an outer surface, and a non-metallic insulator is attached to the tip and covers a portion of its outer surface. Each of the injectors are positioned at least partially within an engine cylinder. The engine provided includes at least one engine compression release brake.

BEST MODE FOR CARRYING OUT THE INVENTION

Figure 1:
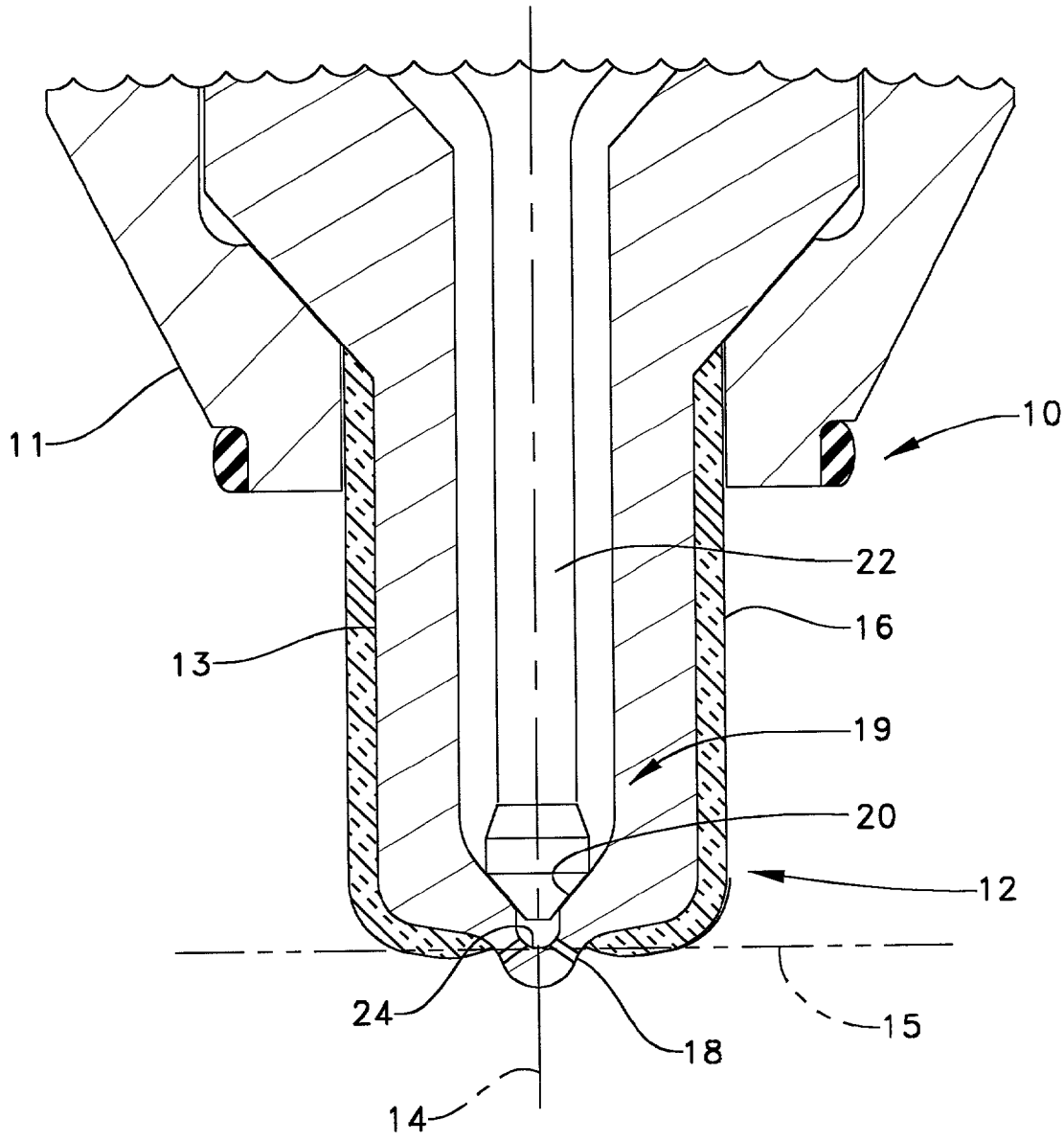
FIG. 1 is a partial sectioned side view of a fuel injector according to the present invention.

Referring to FIG. 1, there is shown a partial sectioned side view of a fuel injector 10 according to the present invention. Injector 10 has an injector body 11 with a metallic tip 12. A needle valve 19 is positioned within injector 10 and alternately opens or closes a valve seat 20. A non-metallic insulator 16 is attached to a portion of the outer surface 13 of injector tip 12. Injector body 11 defines a plurality of nozzle outlets 18 which fluidly connect to a sac 24 below valve seat 20.

Injector body 11 has a centerline 14 which is perpendicular to a plane 15. Plane 15 intersects injector body 11 and centerline 14 at a point which preferably lies between valve seat 20 and nozzle outlets 18. In the preferred embodiment, insulator 16 is attached to the portion of the outer surface 13 of injector tip 12 which lies above plane 15 such that nozzle outlets 18 are not covered. FIG. 1 also shows that an outwardly directed centerline from the nozzle outlets 18 does not intersect insulator 13. Also in the preferred embodiment, insulator 13 is ceramic and is preferably less than about three millimeters thick. The ceramic material is preferably sized and sufficiently resistant to heat transfer that valve seat 20 is not heated to or above its tempering temperature during combustion or braking.

Figure 2:
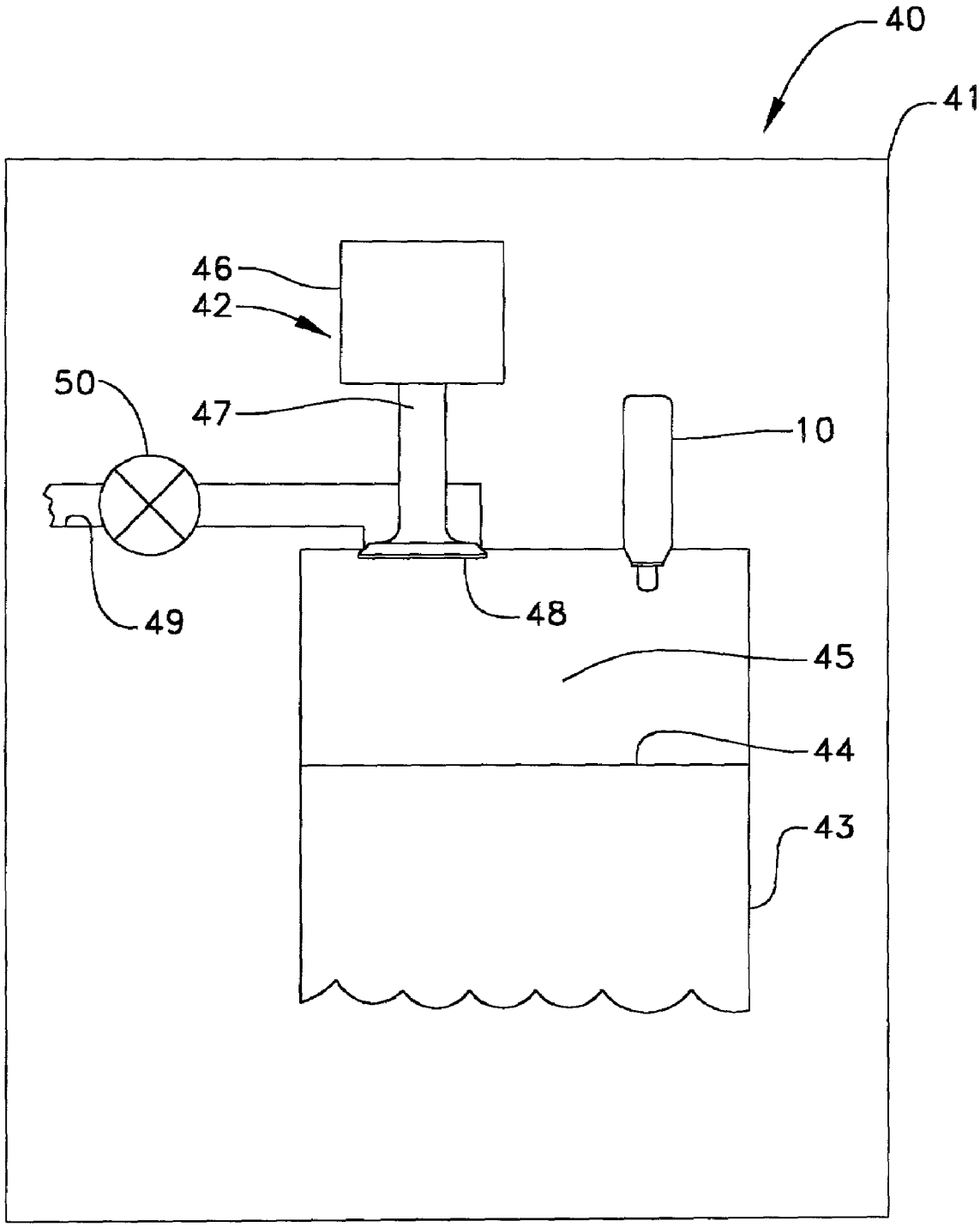
FIG. 2 is a diagrammatic representation of an engine with an engine compression release brake according to present invention.

Referring now to FIG. 2, there is shown an engine 40 according to the present invention, which is preferably a four-cycle compression-ignition (diesel) engine. Engine 40 includes at least one fuel injector 10 from FIG. 1 and at least one engine compression release brake 42 which are attached to an engine housing 41. A piston 43 is shown which has a piston face 44 exposed to a combustion chamber 45. Injector 10 is preferably positioned such that it extends partially into combustion chamber 45. Combustion chamber 45 can be opened to an exhaust line 49 by an engine compression release brake valve 48, and is controlled by an engine brake actuator 46 which moves an engine compression release valve member 47 to an open position when piston 43 nears top dead center during engine braking. Positioned in exhaust line 49 is an exhaust valve 50, that is movable between a first position in which flow through exhaust line 49 is unrestricted and at least one other position in which flow through exhaust line 49 is restricted.

INDUSTRIAL APPLICABILITY

Referring to FIG. 2, when engine braking is desired, fuel injection through injector 10 is halted and engine brake valve 48 is closed. During a compression stroke, piston 43 moves upward and compresses air in chamber 45. When piston 43 nears its top dead center position, engine brake actuator 46 moves engine brake valve member 47 to open engine brake valve 48. Consequently, air compressed by the upward movement of piston 43 is expelled into the exhaust line through valve 48. This compression of air in chamber 45 requires a substantial amount of the engine's energy, which is lost when valve 48 is opened and the pressurized air is expelled. This consumption of energy produces a retarding torque on the engine, corresponding to the energy required to compress the air. As piston 43 begins to move down, an intake valve (not shown) is preferably opened to allow air to be drawn back into chamber 45 in preparation for the next compression cycle if desired.

In a four-cycle engine braking scheme, each engine piston compresses air every other stroke, heating the air substantially as it is compressed. Thus, during periods of engine braking, the injector tip is subjected to relatively high temperatures. In addition to these periods of engine braking, exhaust valve 50 can be adjusted such that a flow restriction is present in exhaust line 49. When this flow restriction is present in exhaust line 49, evacuation of compressed air from combustion chamber 45 is slowed, corresponding to a period of exhaust braking. During periods of simultaneous engine braking and exhaust braking, air within combustion chamber 45 becomes hotter still, subjecting injector tip 12 to even higher temperatures.

In a two-cycle scheme, the pistons compress air every time they travel toward their top position. The more frequent compression strokes required for two-cycle engine braking result in greater retarding torque on the engine than in four-cycle braking, but have the negative effect of increased heating of the engine components. This problem is compounded in systems where engine braking is boosted. In boosting applications, some of the air compressed by one piston is expelled via an exhaust manifold into another cylinder where it is compressed further rather than vented through an exhaust line. Because the piston in the boosted cylinder compresses air drawn in through its intake valve as well as additional air forced in from another cylinder, it must compress a greater total volume of air than a piston in a conventional engine braking scheme. This places even greater retarding torque on the engine, making boosted braking a highly effective method of reducing engine speed. However, because the pistons in a boosted engine braking scheme compress more air than they would in a conventional scheme, and the air is already heated from compression in another cylinder, temperatures inside the boosted cylinder can become extremely high, reaching or exceeding the tempering temperature of the metal used in conventional fuel injectors.

Referring to FIG. 1, there is shown a portion of injector 10 including its tip 12 which would be exposed in a combustion space in the preferred embodiment of the present invention. During boosted compression release braking, tip 12 is exposed to temperatures at or exceeding the tempering temperature of the metal of which it is comprised. Because a metal loses its enhanced hardness when reheated to its tempering temperature, an unshielded injector tip is likely to soften when exposed to the high temperatures produced in a boosted compression release braking event.

In injector 10, needle valve member 22 controls the spray of fuel into the combustion space. Precise control over initiation and termination of injection events requires needle valve member 22 to open and close valve seat 20 rapidly, requiring a relatively large amount of force. When the metal of an injector tip has been reheated to its tempering temperature, the repeated impacts of needle valve member 22 on valve seat 20 can distort its shape. This distortion results in incomplete closing of valve seat 20, and therefore incomplete termination of fuel spray, which causes a decrease in fuel efficiency and an increase in undesirable engine emissions. In extreme cases, the loss of tempering in the injector tip can cause accelerated fatigue, which can lead the tip to break off, resulting in catastrophic engine failure.

The present invention overcomes these problems by attaching a ceramic insulator 16 to tip 12, protecting tip 12 from the extreme temperatures which are reached in the combustion space particularly during a boosted engine braking event. Insulator 16 is preferably attached to injector tip 12 in such a way that it protects the area vulnerable to distortion, which extends from plane 15 over the outer surface 13 of tip 12 to a point beyond valve seat 20. During a two-cycle boosted engine braking event, when the injector tip temperatures are highest, insulator 16 prevents the vulnerable portion of tip 12 from reaching its tempering temperature.

Those skilled in the art will appreciate that various modifications could be made to the disclosed embodiments without departing from the intended scope of the present invention. For instance, rather than attaching the insulator only above the nozzle outlets, an insulator might be provided that covered the nozzle outlets, but allowed fuel to spray through perforations. Further, in addition to the engine disclosed herein, other engines and engine applications where extreme temperatures are reached in the combustion chamber might benefit through the use of the present invention. Other aspects and features of the present invention can be obtained from a study of the drawings, the disclosure, and the appended claims.

The invention claimed is:

1. A fuel injector for use in an engine equipped with an engine compression release braking system, comprising:

an injector body with a metallic tip defining a plurality of nozzle outlets and also having an outer surface;

means for protecting said metallic tip from overheating from compression release braking, and said means including a non-metallic insulator attached at a contact with, and surrounding a portion of, said outer surface; and an outwardly directed centerline from each of said plurality of nozzle outlets does not intersect said insulator.

2. The fuel injector of claim 1 wherein said metallic tip includes a valve seat and a tip centerline; and said insulator covers said outer surface only above a plane that is perpendicular to said tip centerline and positioned between said nozzle outlets and said valve seat.

3. The fuel injector of claim 1 wherein said non-metallic insulator includes a ceramic material.

4. The fuel injector of claim 3 wherein said non-metallic insulator is ceramic.

5. The fuel injector of claim 4 wherein said non-metallic insulator is less than about 3 millimeters thick.

6. The fuel injector of claim 5 wherein said insulator is sufficiently resistant to heat transfer such that the temperature of said valve seat would not reach a tempering temperature if exposed to conditions corresponding to engine compression release braking.

7. The fuel injector of claim 1 wherein said tip includes said valve seat and said centerline;

said insulator covers said outer surface only above a plane that is perpendicular to said centerline and positioned between said nozzle outlets and said valve seat;

said insulator includes a ceramic material; and said insulator is sufficiently resistant to heat transfer such that the temperature of said valve seat would not reach a tempering temperature if exposed to conditions corresponding to engine compression release braking.

8. The fuel injector of claim 1 wherein said insulator is sufficiently resistant to heat transfer such that the temperature of the valve seat does not reach said tempering temperature if exposed to conditions corresponding to simultaneous engine compression release braking and exhaust braking.

9. A method of reducing injector tip overheating due to engine compression release braking, comprising the steps of:

performing engine compression release braking in a engine cylinder having a fuel injector partially positioned therein;

providing said a fuel injector with a metallic tip having an outer surface; and attaching a non-metallic insulator to at a contact with, and surrounding a portion of, said outer surface, but not intersecting an outwardly directed centerline of each of a plurality of nozzle outlets.

10. The method of claim 9 wherein said tip includes a valve seat and a tip centerline;

said attaching step includes a step of attaching said insulator to said outer surface only above a plane perpendicular to said tip centerline, positioned between said valve seat and said nozzle outlets.

11. The method of claim 9 including a step of choosing an insulating material; and sizing and attaching said insulating material such that the temperature of said valve seat does not reach a tempering temperature during engine compression release braking.

12. An engine comprising:

an engine housing having a cylinder disposed therein;

a fuel injector according to claim 1 attached to said engine housing with said metallic tip partially positioned in said cylinder; and an engine compression release brake attached to said housing adjacent said cylinder.

13. The engine of claim 1 wherein said insulator is sufficiently resistant to heat transfer such that the temperature of the valve seat does not reach said tempering temperature if exposed to conditions corresponding to engine compression release braking.

14. The engine of claim 13, including an exhaust brake operably coupled to an exhaust from said engine.

15. The engine of claim 13 wherein said engine compression release brake includes means for performing boosted compression release braking.

16. The engine of claim 13 wherein said metallic tip includes a valve seat and a tip centerline; and said insulator covers said outer surface only above a plane that is perpendicular to said tip centerline and positioned between said nozzle outlets and said valve seat.

17. The engine of claim 13 wherein said non-metallic insulator includes a ceramic material.

18. The engine of claim 13 wherein said non-metallic insulator is less than about 3 millimeters thick.

* * * * *